US009661902B2

(12) United States Patent
Mikuma et al.

(10) Patent No.: US 9,661,902 B2
(45) Date of Patent: May 30, 2017

(54) WATERPROOF SLIDE FASTENER

(75) Inventors: Ryo Mikuma, Toyama (JP); Makoto Takayama, Toyama (JP); Hisashi Yoneshima, Toyama (JP)

(73) Assignee: YKK Corporation (JP)

( * ) Notice: Subject to any disclaimer, the term of this patent is extended or adjusted under 35 U.S.C. 154(b) by 136 days.

(21) Appl. No.: 14/411,560

(22) PCT Filed: Jul. 2, 2012

(86) PCT No.: PCT/JP2012/066920

§ 371 (c)(1),
(2), (4) Date: Dec. 29, 2014

(87) PCT Pub. No.: WO2014/006684

PCT Pub. Date: Jan. 9, 2014

(65) Prior Publication Data

US 2015/0157096 A1 Jun. 11, 2015

(51) Int. Cl.
*A44B 19/32* (2006.01)
*A44B 19/24* (2006.01)
(Continued)

(52) U.S. Cl.
CPC ..... *A44B 19/32* (2013.01); *A44B 19/08* (2013.01); *A44B 19/42* (2013.01); *Y10T 24/2514* (2015.01)

(58) Field of Classification Search
CPC ..... A44B 19/08; A44B 19/42; A44B 19/32; A44B 19/24
(Continued)

(56) References Cited

U.S. PATENT DOCUMENTS 2,422,249 A * 6/1947 Malluk ..... A43B 3/02 24/389
2,526,600 A * 10/1950 Bolten, Jr. ..... A44B 19/04 24/410
(Continued)

FOREIGN PATENT DOCUMENTS

JP 036119/1982 2/1982
JP 020815/1985 2/1985
(Continued)

OTHER PUBLICATIONS

International Search Report, PCT Application No. PCT/JP2012/066920, mailed Sep. 18, 2012.

*Primary Examiner* — Robert J Sandy
*Assistant Examiner* — Jason W San
(74) *Attorney, Agent, or Firm* — Kilpatrick Townsend & Stockton LLP

(57) ABSTRACT

A waterproof slide fastener with waterproof property in which covering the whole front and rear faces of a woven or knitted fastener tape with an elastomer, and fastener elements made of a thermoplastic resin are injection molded on the lateral edge of the fastener tape. In particular, a waterproof slide fastener that can maintain the watertightness and airtightness even when the fastener tape is bent in the lengthwise direction because, on the assumption that the minimum width between the outer end edges of the neck part of the fastener element in the lengthwise direction of the fastener tape that is a slide direction in which the slider slides is N and the width between the outer end edges of the body part of the fastener element in the same lengthwise direction is B, the value of B/N is between 2.5 and 3.5.

3 Claims, 9 Drawing Sheets

(51) Int. Cl.
*A44B 19/08* (2006.01)
*A44B 19/42* (2006.01)

(58) Field of Classification Search
USPC ..... 24/389
See application file for complete search history.

(56) References Cited

U.S. PATENT DOCUMENTS 3,668,745 A * 6/1972 Krupp ..... A44B 19/32 24/389
3,825,978 A * 7/1974 Sakalys ..... A44B 19/04 24/405
3,914,827 A * 10/1975 Brown ..... A44B 19/32 24/389
3,924,305 A * 12/1975 Hamamura ..... A44B 19/32 24/389
4,580,321 A * 4/1986 Tanikawa ..... A44B 19/32 24/384
4,607,416 A * 8/1986 Tanikawa ..... A44B 19/32 24/384
4,641,400 A * 2/1987 Moreland ..... A63C 19/12 135/119
4,658,480 A * 4/1987 Morioka ..... A44B 19/04 24/384
4,724,586 A * 2/1988 Tsubokawa ..... A44B 19/32 24/384
4,765,038 A * 8/1988 Kasai ..... A44B 19/06 24/389
6,622,351 B2 * 9/2003 Takasawa ..... A44B 19/26 24/389
7,870,649 B2 * 1/2011 Mikuma ..... A44B 19/04 24/403
9,295,307 B2 * 3/2016 Tominaga ..... A44B 19/32
9,386,826 B2 * 7/2016 Lu ..... A44B 19/346
2004/0237266 A1 * 12/2004 Wang ..... A44B 19/32 24/389
2005/0217086 A1 * 10/2005 Kusayama ..... A44B 19/08 24/389
2006/0130292 A1 * 6/2006 Kondo ..... A44B 19/08 24/403
2006/0207069 A1 * 9/2006 Cheng ..... A44B 19/32 24/389
2006/0282995 A1 * 12/2006 Liou ..... A44B 19/32 24/389
2007/0074380 A1 * 4/2007 Matsumoto ..... A44B 19/32 24/389
2007/0094852 A1 * 5/2007 Wang ..... A44B 19/32 24/389
2007/0137006 A1 * 6/2007 Mikuma ..... A44B 19/04 24/403
2007/0163091 A1 * 7/2007 Bernasconi ..... A44B 19/32 24/389
2007/0169320 A1 7/2007 Kusayama et al.
2007/0226966 A1 * 10/2007 Tominaga ..... A44B 19/32 24/389
2008/0189918 A1 * 8/2008 Kusayama ..... A44B 19/32 24/389
2010/0125982 A1 * 5/2010 Chou ..... A44B 19/32 24/397
2012/0137476 A1 * 6/2012 La Rocca ..... A44B 19/06 24/405
2012/0246886 A1 * 10/2012 Matsumoto ..... A44B 19/32 24/381
2013/0014355 A1 * 1/2013 Lee ..... A44B 19/32 24/389
2014/0130974 A1 * 5/2014 Chen ..... A44B 19/42 156/270
2014/0304954 A1 * 10/2014 La Rocca ..... A44B 19/08 24/389
2014/0359978 A1 * 12/2014 Wang ..... A44B 19/42 24/389
2014/0359979 A1 * 12/2014 Gonda ..... A44B 19/32 24/415
2014/0366336 A1 * 12/2014 Chung ..... A44B 19/32 24/389
2014/0366337 A1 * 12/2014 Chou ..... A44B 19/24 24/389
2015/0157096 A1 * 6/2015 Mikuma ..... A44B 19/32 24/389

FOREIGN PATENT DOCUMENTS

JP 2005-237577 A 9/2005
JP 2007-167220 A 7/2007

* cited by examiner

WATERPROOF SLIDE FASTENER

This application is a national stage application of PCT/JP2012/066920, which is incorporated herein by reference.

TECHNICAL FIELD

The invention relates to a waterproof slide fastener with waterproof property in which covering the whole front and rear faces of a woven or knitted fastener tape with an elastomer causes the fastener tape to be waterproof, and fastener elements made of a thermoplastic resin are injection molded on the lateral edge of the fastener tape and, in particular, to a waterproof slide fastener that has an excellent waterproof property and can maintain the watertightness and airtightness even when the fastener tape is bent in the lengthwise direction.

BACKGROUND ART

To prevent a liquid such as water from entering the inside, for example, of a wet suit or a wader while the opening and closing portion or the opening is closed, a slide fastener having waterproof property (hereinafter, referred to as a "waterproof slide fastener") is often used at the opening and closing portion or the opening. Note that, herein, the waterproof property means the resistance to passage of not only water but also a liquid other than water. Some waterproof slide fasteners not only prevent the entry of liquid but also exert airtightness to prevent the entry of gas.

A waterproof slide fastener usually includes a pair of right and left fastener stringers in which element rows are formed on waterproof tapes each having a waterproof layer, and a slider that can slide along the element rows. The right and left element rows engage with each other such that the facing edge parts of the right and left waterproof tapes are in close contact with each other. This prevents water from entering the rear face side of the tape from the front face side of the tape (or entering the front face side of the tape from the rear face side of the tape) through a space between the right and left waterproof tapes.

Note that, hereinafter, the vertical direction is the lengthwise direction of a waterproof fastener tape, and is the same as the slide direction in which the slider slides. Especially, the direction in which the slider slides to engage the right and left element rows with each other in order to close a waterproof slide fastener is referred to as an upward direction, and the direction in which the slider slides to disengage right and left fastener elements in order to open the waterproof slide fastener is referred to as a downward direction. Furthermore, the horizontal direction is the width direction of the waterproof fastener tape and is the direction parallel to the tape face of the waterproof fastener tape and perpendicular to the lengthwise direction of the tape. Furthermore, the longitudinal direction is the direction of the front and rear faces of the waterproof fastener tape and perpendicular to the tape face of the waterproof fastener tape. Especially, the direction on the side of the waterproof fastener tape on which a tab of the slider is placed is the frontward direction and the direction on the opposite side is the rearward direction.

For example, JP 2005-237577 A (Patent Document 1) and JP 2007-167220 A (Patent Document 2) each disclose a waterproof slide fastener.

As illustrated in FIG. 8, the waterproof slide fastener described in Patent Document 1 is a waterproof slide fastener with waterproof property in which covering both of the front and rear faces of each of woven or knitted fastener tapes 110 with a thermoplastic elastomer causes the fastener tape to be waterproof; through-holes 114 penetrating the front and rear faces are provided at positions at which fastener elements are attached to the end edges 111*a* of the fastener tape; the fastener elements each made of a thermoplastic resin and formed of a coupling head 122, a neck part 123, a body part 124, a shoulder part 125, and a leg part 127 are attached to the end edge 111*a* with injection molding; each of the through-holes 114 is covered with leg parts 127 of the fastener element; and a connecting portion 121*c* connects the leg parts 127 on the front and rear faces through the through hole.

As illustrated in FIG. 9, the waterproof slide fastener described in Patent Document 2 is a waterproof slide fastener in which a whole fastener tape 2 is covered with an elastomer; a through-hole 208 is provided on the lateral edge of the fastener tape 202; a fastener element 203 formed of a coupling head 210, a neck part 212, an engaged projecting portion 213, a leg part 214, and a tongue portion 216 is injection molded so as to cover the through-hole 208; and a reinforcement part 218 projects on a side of the leg part 214 in the lengthwise direction of the through-hole 208 while covering a part of the through-hole 208 and surrounding the through-hole 208. The reinforcement part 218 prevents a through-hole 208 from being exposed even when the fastener tape 202 is bent. This allows the waterproof slide fastener to maintain watertightness and airtightness.

CITATION LIST

Patent Document

Patent Document 1: JP 2005-237577 A
Patent Document 2: JP 2007-167220 A

SUMMARY OF INVENTION

Technical Problem

Such waterproof slide fasteners in Patent Document 1 and Patent Document 2 are configured to keep the facing end edges of waterproof fastener tapes in close contact with each other by causing coupling heads and shoulder parts of fastener elements attached on the end edges of the waterproof fastener tapes to engage with each other when the slide fastener is closed. The waterproof fastener tapes are attached to and used for work clothes, for example, a wet suit or a wader. When the waterproof fastener tapes are bent into a U shape in vertical direction due to a work activity, there is a problem in that the watertightness and airtightness are not maintained because the right and left element rows on the projecting side are disengaged and the close contact of the facing end edges of the waterproof fastener tapes is broken.

In light of the conventional problem, a specific objective of the invention is to provide a waterproof slide fastener with a higher waterproof property that can maintain watertightness and airtightness even when the waterproof fastener tapes are bent into a U shape in vertical direction, for example, due to a work activity of the worker.

Solution to Problem

As illustrated in FIGS. 1 to 3, a waterproof slide fastener of the invention includes:

a pair of fastener stringers (2) including a plurality of fastener elements (21) arranged along facing element attachment edge parts (11) of a pair of waterproof fastener tapes (10) in which a waterproof layer (13) made, for example, of an elastomer resin is formed on a woven or knitted belt-shaped core material (12); and a slider configured to engage and disengage the fastener elements (21).

In the waterproof slide fastener, each of the fastener elements (21) is made of a synthetic resin material and includes front and rear half parts (21*a*, 21*b*) integrally formed on the front and rear face sides of the waterproof fastener tape (10), and the front and rear half parts (21*a*, 21*b*) each include a coupling head (22), a neck part (23) continuously formed from the coupling head (22) and constricted in a lengthwise direction of the waterproof fastener tape (10), and a body part (24) continuously formed from the neck part (23), the front and rear half parts (21*a*, 21*b*) are integrally connected to each other with a connecting portion (21*c*) through a through-hole (14) formed on the element attachment edge part (11), and end edges (11*a*) of the element attachment edge parts (11) are formed such that edge faces of the facing waterproof fastener tapes (10) are in contact with each other by pressure when the fastener elements (21) are engaged.

To achieve the objective, the primary characteristic of the waterproof slide fastener provided by the invention is a matter that the waterproof slide fastener has a shape of the fastener elements (21) in which "on an assumption that a minimum width between outer end edges of the neck part (23) in the lengthwise direction of the waterproof fastener tape (10) is N, and a width between outer end edges of the body part (24) in the lengthwise direction of the waterproof fastener tape (10) is B, a value of B/N is between 2.5 and 3.5" as the basic structure.

The inventors of the invention have investigated the cause of the problem in that the right and left element rows are disengaged on the projecting side and the close contact of the facing end edges of the water resistant tapes is broken when a conventional waterproof slide fastener is bent into a U shape in the vertical direction and have considered the measures. As a result, the matter is led as the characteristic.

The cause of breaking the close contact state will be described based on the conventional waterproof slide fastener in FIG. 8. FIGS. 10 and 11 are cross-sectional views viewed along arrows S4-S4 in FIG. 8. FIG. 10 illustrates the waterproof slide fastener before being bent. FIG. 11 illustrates a slide fastener 101 in FIG. 8 when the slide fastener 101 is bent in the vertical direction. When the waterproof slide fastener 1 is closed, front and rear half parts 22*a*, 22*b* of the coupling heads 22 and front and rear half parts 25*a*, 25*b* of the shoulder parts 25 of the fastener elements 21 attached on the end edges of the waterproof fastener tapes 10 engage with each other. This keeps the facing end edges of the waterproof fastener tapes 10 in the close contact state. However, when the waterproof slide fastener 1 is bent in the vertical direction, the front half parts 23*a* of the neck parts 23 of the two adjacent fastener elements 21 push the front half part 22*a* of the coupling head 22 on the concave side. This pushes up the rear half part 22*b* of the coupling head 22 on the projecting side. When the degree to which the slide fastener is bent increases, the rear half parts 22*b* of the coupling heads 22 and the rear half parts 25*b* of the shoulder parts 25 are disengaged on the projecting side. This breaks the close contact state of the facing end edges of the waterproof fastener tapes.

From the investigation, the inventors have found that it is important to reduce the degree to which the coupling head is pushed on the concave side from the degree in the conventional slide fastener, or to limit the bending that is the force to push the coupling head in order to maintain the watertightness and airtightness of the waterproof slide fastener even when the waterproof slide fastener is bent in the vertical direction.

FIG. 6 is a plan view of the principal parts of the waterproof slide fastener of the invention that is the same as in FIG. 1, mainly illustrating the coupling portion. First, the name and definition of the dimension of each part in the fastener element 21 of the invention will be described with reference to the drawing. All of B (the body width), G (the space between the body parts), S (the shoulder width), P (the pitch), H (the height of the crest), and N (the neck part width) are lengths in the lengthwise direction of the waterproof fastener tape that is the slide direction of the slider or, namely, in the vertical direction.

B: the width between the outer end edges of the body part of each of the fastener elements G: the distance between the facing outer end edges of the body parts of the two adjacent fastener elements placed in the same direction S: the width between the outer end edges of the shoulder part of each of the fastener elements P: the distance between the center lines of the two adjacent fastener elements placed in the same direction H: the maximum width between the outer end edges of the coupling head of each of the fastener elements N: the minimum width between the outer end edges of the neck part of each of the fastener elements The L (the entire length of the element) is in a direction perpendicular to the lengthwise direction of the waterproof fastener tape, in other words, L is the horizontal length between the front end edge of the coupling head and the front end edge of the leg part of the fastener element.

Note that the fastener element 21 of the invention actually has a little draft angle because being formed with injection molding. The definition of the dimension of each parts of the fastener element 21 is based on the shape of the fastener element 21 projected in the longitudinal direction, namely, the shape without a draft angle.

In the waterproof slide fastener 1 of the invention, reducing N than that in the conventional slide fastener generates a mechanism reducing the degree to which the neck parts 23 of the two adjacent fastener elements 21 push the coupling head 22 on the concave side when the slide fastener is bent from the degree in the conventional slide fastener (hereinafter, referred to as a "push reducing mechanism"), and increasing B than that in the conventional slide fastener generates a mechanism limiting the bending that is the force to push the coupling head 22 by causing the body parts 24 of the two adjacent fastener elements 21 to abut against each other even when the slide fastener is strongly bent (hereinafter, referred to as a "bend limiting mechanism").

To prevent the coupling head 22 from being pushed, it is preferable to reduce N than that in the conventional slide fastener as much as possible and to increase B as much as possible. However, reducing N decreases the mechanical strength of the fastener elements 21, and increasing B decreases the flexibility of the waterproof slide fastener 1. Thus, the value of B/N is preferably between 2.5 and 3.5.

As described above, reducing N and increasing B from those in the conventional slide fastener causes the shape of the fastener element 21 of the waterproof slide fastener 1 of the invention (see FIG. 1) to have a largely-constricted neck part 23 and an extended shoulder as compared with the shape in the conventional slide fastener (see FIGS. 8 and 9).

Furthermore, it is preferable in the waterproof slide fastener 1 of the invention to increase B that has been designed to have the same width as S (shoulder width) in the conventional slide fastener (see FIGS. 8 and 9) to a width larger than S with the increase in B (the body width) as described above. It is not preferable to increase S with the increase in B because when the flange portion of the slider is guided and slid, the increase makes it difficult to move the coupling head 22 of the fastener element 21 so as to increase the space between the adjacent fastener elements 21 inside the slider and this increases the sliding resistance generated when the slider slides.

As illustrated in FIG. 6, the vertical distance between the place at which the space between the outer end edges of the neck part 23 of a first fastener element 21 has the minimum width, and the coupling head 22 of a second fastener element 21 adjacent to the first fastener element 21 and placed in the opposite direction of the first fastener element 21 can be expressed by (P−N−H)/2 when the waterproof slide fastener 1 is closed. It is preferable in the waterproof slide fastener 1 in the invention that a total distance (P−N−H) and a distance G satisfy the relationship of the following expression. The (P−N−H) is the total distance of the voids at two places on and under the place at which the space between the outer end edges of the neck part 23 of the first fastener element 21 has the minimum width. A distance G between the outer end edges of the body parts 24 of the adjacent fastener elements 21 facing the same direction.

Expression: $0.5 \leq (P-N-H)/G \leq 1.0$

It is not preferable that the value is smaller than 0.5 because the bend limiting mechanism does not work unless the bending progresses to a significant degree. It is not preferable also that the value is larger than 1.0 because this reduces the strength of the neck part 23 or reduces the flexibility of the waterproof slide fastener 1.

An R (radius of curvature) is put on a ridge line portion on the upper face of the fastener element 21 of the waterproof slide fastener 1 of the invention. It is preferable that R (radius of curvature) on the ridge line portion of the coupling head 22 is 0.7 mm or less, and R (radius of curvature) on the ridge line portion of the neck part 23 is 0.4 mm or less. As described above, the ridge line portions of the coupling head 22 and the neck part 23 have a shape rising perpendicularly as compared with those in the conventional slide fastener. This makes it difficult for the neck parts 23 of the two adjacent fastener elements 21 to push the coupling head 22. Accordingly, the push reducing mechanism can be further enhanced.

As an example, R (radius of curvature) on the ridge line portion of the coupling head 22 can be designed as 0.3 mm (conventionally around 0.8 mm), and R (radius of curvature) on the ridge line portion of the neck part 23 can be designed as 0.2 mm (conventionally around 0.5 mm).

Each of the front and rear half parts 21*a*, 21*b* of the fastener element 21 of the waterproof slide fastener 1 according to the invention can include a leg part 27, but preferably includes two or more leg parts 27 (in FIG. 1, the leg part 27 of the front half part 21*a* of the fastener element 21 branches from a crotch portion 26 into two leg parts 27*a*, 27*a*). As described above, the leg part 27 branches into two or more parts. This can reduce the area of the leg part 27 per half part of the fastener element 21 on a sliding contact face on which the flange portion of the slider is led and slid. This reduces the sliding resistance when the slider slides and thus can cause the slider to lightly slide.

The waterproof slide fastener 1 of the invention including the above-mentioned matter can readily and efficiently be produced, for example, with a producing apparatus described in JP 2005-237577 A cited as Patent Document 1. The waterproof slide fastener 1 of the invention including the above-mentioned matter can be provided as a waterproof product with an excellent waterproof performance by being sewn on an object to which a fastener is to be attached.

Advantageous Effects of Invention

A waterproof slide fastener of the invention can prevent a coupling head and a shoulder part from being disengaged on a projecting side, and thus can prevent the close contact state of the facing end edges of waterproof fastener tapes from being broken. This is because the degree to which neck parts of two adjacent fastener elements push the coupling head on the concave side decreases even when the waterproof fastener tape is bent into a U shape in the vertical direction, and causing body parts of the two adjacent fastener elements to abut against each other limits the bending that is the force to push the coupling head when the slide fastener is strongly bent.

Especially, when the waterproof slide fastener according to the invention is attached on work clothes such as a wet suit or a wader, the work activity does not break the close contact state of the waterproof fastener tapes. Thus, the worker can work at ease.

DESCRIPTION OF EMBODIMENTS

Preferred embodiments of the invention will be described in detail hereinafter with reference to the drawings. Note that the invention is not limited to any concrete examples described below, and can variously be changed as long as the variation essentially includes the same components as the invention and has a function effect similar to the invention.

Note that, hereinafter, the vertical direction is the lengthwise direction of a waterproof fastener tape, and is the same as the slide direction in which the slider slides. Especially, the direction in which the slider slides to engage the right and left element rows with each other in order to close the waterproof slide fastener is referred to as an upward direction, and the direction in which the slider slides to disengage the right and left fastener elements in order to open the waterproof slide fastener is referred to as a downward direction. Furthermore, the horizontal direction is the width direction of the waterproof fastener tape and is the direction parallel to the tape face of the waterproof fastener tape and perpendicular to the lengthwise direction of the tape. Furthermore, the longitudinal direction is the direction of the front and rear faces of the waterproof fastener tape and perpendicular to the tape face of the waterproof fastener tape. Especially, the direction on the side of the waterproof fastener tape on which a tab of the slider is placed is the frontward direction and the direction on the opposite side is the rearward direction.

Figure 1:
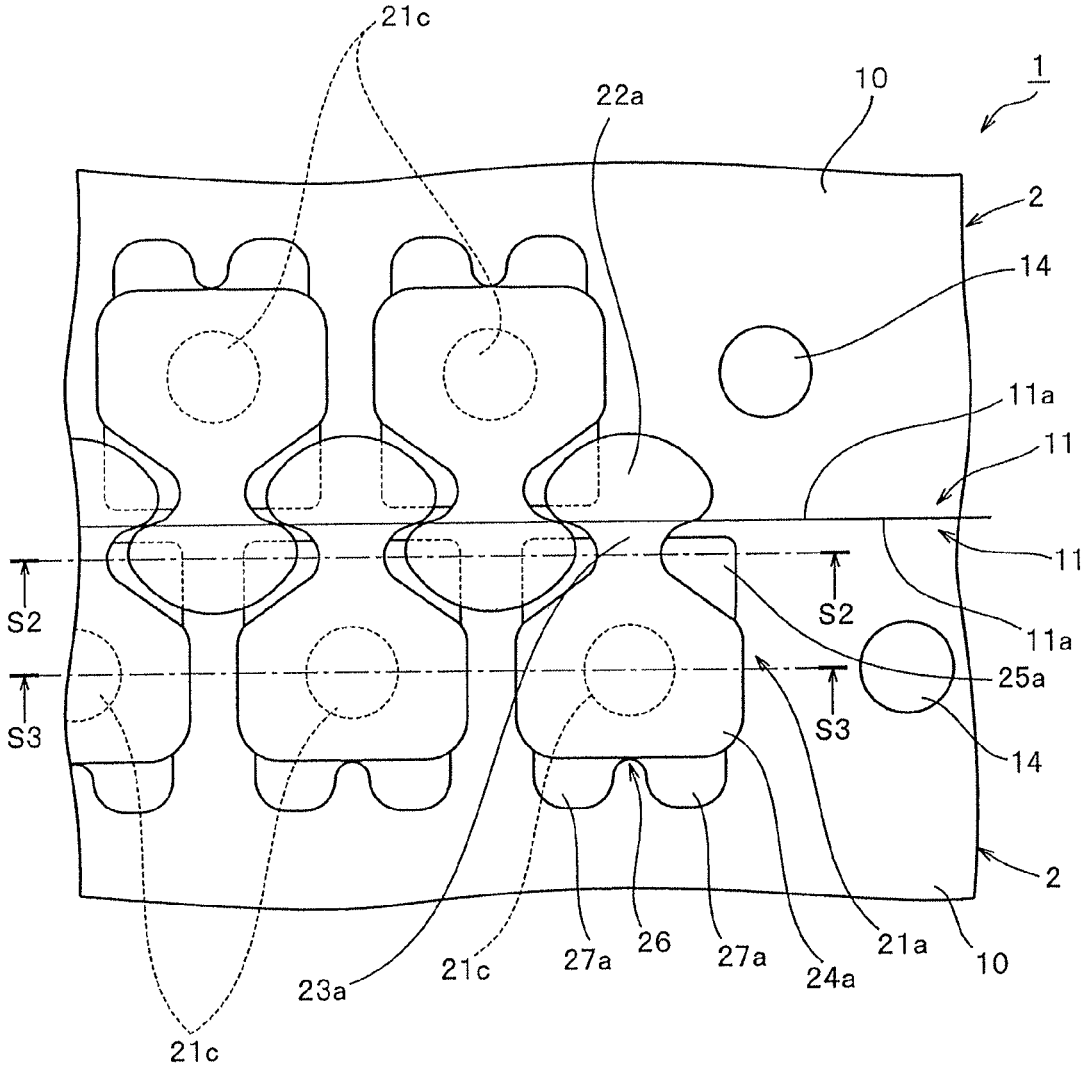
FIG. 1 is a plan view of the principal parts of a waterproof slide fastener of the invention, mainly illustrating the coupling portion.
Figure 2:
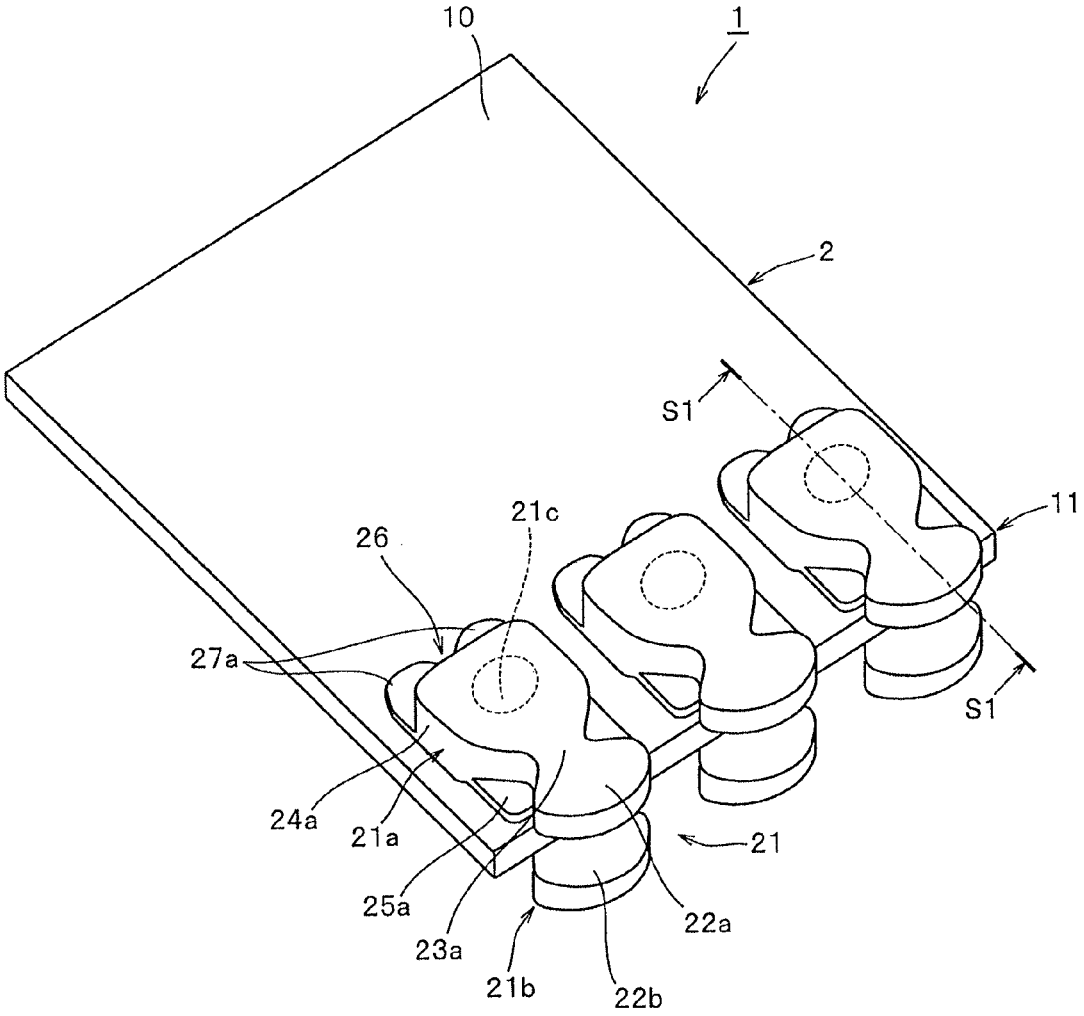
FIG. 2 is a perspective view of a fastener stringer of the waterproof slide fastener illustrated in FIG. 1.

FIG. 1 is a plan view of the principal parts of a waterproof slide fastener of the invention, mainly illustrating the coupling portion. FIG. 2 is a perspective view of a fastener stringer of the waterproof slide fastener illustrated in FIG. 1.

A waterproof slide fastener 1 illustrated in FIGS. 1 and 2 is attached to an opening or an opening and closing portion of an object to which a fastener is to be attached such as a wet suit. The waterproof slide fastener 1 has liquid-tightness such that a liquid such as water does not leak from the outside to the inside (or, from the inside to the outside) of the object to which the fastener is attached through the waterproof slide fastener 1 when the waterproof slide fastener 1 is closed.

Figure 3:
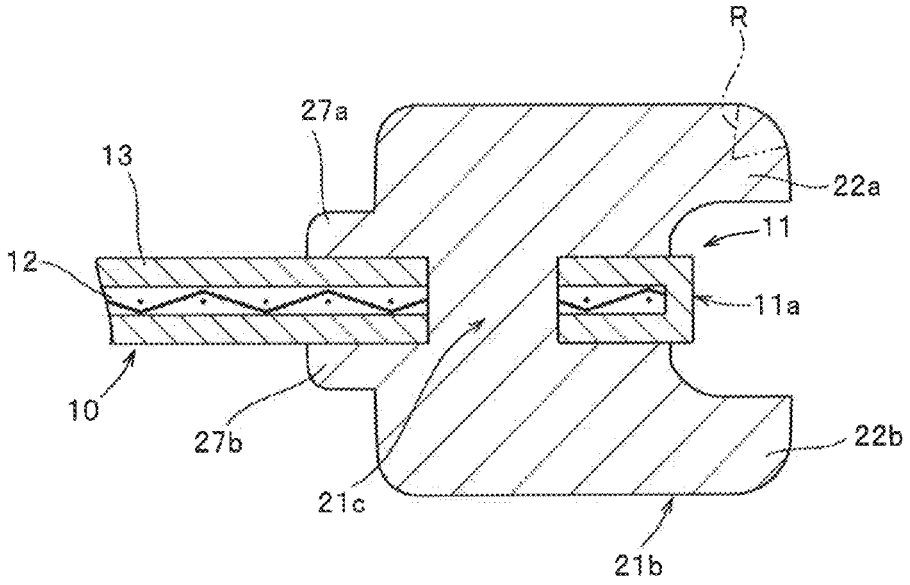
FIG. 3 is a cross-sectional view viewed along arrows S1-S1 of the waterproof slide fastener illustrated in FIG. 2.

The waterproof slide fastener 1 described above includes a pair of waterproof fastener tapes 10 in which a waterproof layer 13 made of an elastomer resin is formed on a woven or knitted belt-shaped core material 12 as illustrated in FIGS. 1 to 3. The waterproof slide fastener 1 includes a pair of right and left fastener stringers 2 on which a plurality of synthetic resin fastener elements 21 is injection-molded along facing element attachment edge parts 11 of the waterproof fastener tapes 10, a slider (not illustrated in the drawings) placed slidably along the element rows including the fastener elements 21 and configured to engage and disengage the right and left rows of the fastener elements 21, a first stopper (not illustrated in the drawings) placed on the lower edge portion side of the element rows, and a second stopper (not illustrated in the drawings) placed on the upper edge portion side of the element row.

As illustrated in FIG. 3, the right and left waterproof fastener tapes 10 each have a waterproof structure in which the waterproof layer 13 made of a polyurethane-based, polyester-based, polyamide-based, or vinyl chloride-based thermoplastic elastomer (for example, a polyester-based thermoplastic elastomer is commercially available from DU PONT-TORAY CO., LTD under the trade name of "Hytrel") is layered on the front and rear faces of the tape of the woven or knitted belt-shaped core material 12.

The waterproof layer 13 of the waterproof fastener tape 10 is made of the thermoplastic elastomer as described above. Thus, the waterproof fastener tapes 10 can be bent in the direction of the front and rear faces of the tape or the width direction of the tape while the waterproof property can stably be maintained and the flexibility of the waterproof fastener tapes 10 increases. This makes the waterproof slide fastener 1 easy to handle. Furthermore, covering the whole surface of the waterproof fastener tape 10 with the thermoplastic elastomer allows the waterproof fastener tape 10 to readily be attached to an object to which a fastener is to be attached with high-frequency welding.

Note that, according to the invention, providing the waterproof layer 13 only on one of the front and rear faces of the waterproof fastener tape 10 (for example, the front face of the tape) can form the waterproof fastener tape 10 as a waterproof tape.

The fastener elements 21 have the same structure as the fastener elements 21 placed in a conventional common waterproof slide fastener 1. Concretely, the fastener elements 21 are formed of an injection-molded thermoplastic resin made of polyacetal, polyamide, polypropylene, polybutylene terephthalate, nylon, or polycarbonate.

Each of the fastener elements 21 includes a coupling head 22 (22*a*, 22*b*) having a elliptical shape of which length in the lengthwise direction of the fastener tape is slightly longer than that in the width direction, a neck part 23 (23*a*, 23*b*) formed continuously from the coupling head 22 and having a shape constricted in the lengthwise direction of the fastener tape, a body part 24 (24*a*, 24*b*) formed continuously from the neck part 23 and having a dimension larger than that of the neck part 23 in the lengthwise direction of the fastener tape, a flat shoulder part 25 (25*a*, 25*b*) extending from the neck part 23 and the body part 24 in the vertical direction and having a thickness thinner than those of the neck part 23 and body part 24 in the direction of the front and rear faces, and a leg part 27 (27*a*, 27*b*) branching and extending from the inside edge portion of the tape of the body part 24 through the crotch portion 26. Furthermore, an engagement recess (not illustrated in the drawings), with which the shoulder part 25 of the fastener element 21 of the engaging counterpart and the end edge 11*a* of the waterproof fastener tape 10 are engaged, is provided as a recess at the top portion (front edge portion) of the coupling head 22 (22*a*, 22*b*). Note that the shoulder part 25 and the leg part 27 are not necessarily provided in an embodiment of the invention although the shoulder part 25 and the leg part 27 are preferably provided to the fastener element 21 as described above in light of the close contact state of the waterproof fastener tapes 10 and the slide of the slider.

Each of the fastener elements 21 includes a front half part (a half portion on the front face side of an element) 21*a* placed on the front face side of the tape and a rear half part (a half portion on the rear face side of the element) 21*b* that hold the end edge 11*a* of the waterproof fastener tape 10 therebetween. The front and rear half parts 21*a*, 21*b* of the fastener element 21 have symmetric shapes with respect to the waterproof fastener tape 10. Each of the front and rear half parts 21*a*, 21*b* is fixed on the waterproof layer 13 of the waterproof fastener tape 10. The front and rear half parts 21*a*, 21*b* are integrally connected to each other through a connecting portion 21*c* formed in the through-hole 14 of the waterproof fastener tape 10.

The end edge 11*a* of the element attachment edge part 11 extends over the neck part 23 such that the edge faces of the facing fastener tapes 10 are in contact with each other when the fastener elements 21 are engaged. Meanwhile the end edge 11*a* is exposed to the coupling head 22 side over the shoulder part 25. A space is formed between the front and rear half parts 22*a*, 22*b* of the coupling head 22. Each of the half parts (22*a*, 22*b*; 27*a*, 27*b*) of each of the coupling head 22 and leg part 27 is formed into a shape thinner than each of the half parts (23*a*, 23*b*; 24*a*, 24*b*) of the neck part 23 and the body part 24 in thickness in a direction perpendicular to the front and rear faces of the waterproof fastener tape 10. Note that the contact of the edge faces of the waterproof fastener tapes 10 can be referred to as a contact by pressure because the edge faces press each other.

Figure 6:
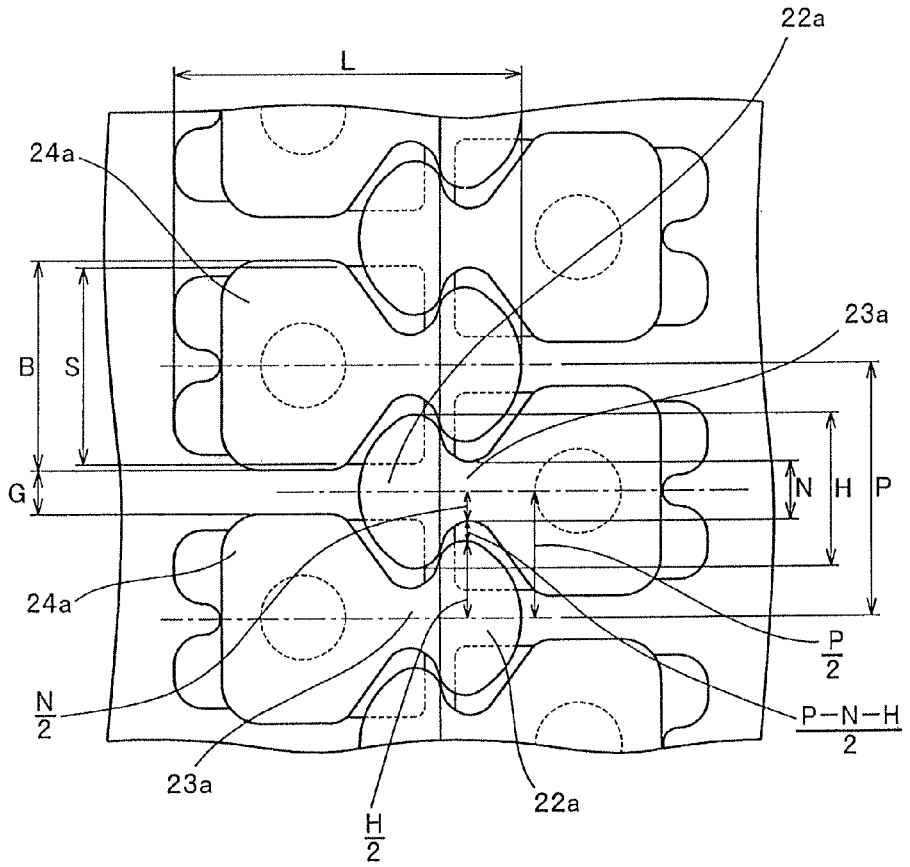
FIG. 6 is a plan view of the principal parts of a waterproof slide fastener of the invention that is the same as in FIG. 1, mainly illustrating the coupling portion.

FIG. 6 is a plan view of the principal parts of the waterproof slide fastener 1 of the invention that is the same as in FIG. 1, mainly illustrating the coupling portion. First, the name and definition of the dimension of each part in a fastener element 21 of the invention will be described with reference to the drawing. All of B (the body width), G (the space between the body parts 24), S (the shoulder width), P (the pitch), H (the height of the crest), and N (the neck part width) are lengths in the lengthwise direction of the waterproof fastener tape that is the slide direction of the slider or, namely, in the vertical direction.

B: the width between the outer end edges of the body part 24 of each of the fastener elements 21

G: the distance between the facing outer end edges of the body parts 24 of the two adjacent fastener elements 21 placed in the same direction S: the width between the outer end edges of the shoulder part of each of the fastener elements 21

P: the distance between the center lines of the two adjacent fastener elements 21 placed in the same direction H: the maximum width between the outer end edges of the coupling head 22 of each of the fastener elements 21

N: the minimum width between the outer end edges of the neck part 23 of each of the fastener elements 21

The L (the entire length of the element) is in a direction perpendicular to the lengthwise direction of the waterproof fastener tape, in other words, L is the horizontal length between the front end edge of the coupling head 22 and the front end edge (inside end edge of the tape) of the leg part 27 of the fastener element 21. Note that, when the fastener element 21 does not include a leg part 27, L (the entire length of the element) is the length between the front end edge of the coupling head 22 and the front end edge (inside end edge of the tape) of the body part 24.

According to the waterproof slide fastener 1 of the invention, N (the minimum width between the outer end edges of the neck part 23) and B (the width between the outer end edges of the body part 24) in the fastener element 21 have a relationship such that the value of B/N is between 2.5 and 3.5. In other words, herein, the B/N is the proportion of the minimum width N of the neck part 23 with respective to the width B of the body part 24.

Note that the fastener element 21 of the invention actually has a little draft angle because of it being formed with injection molding. The definition of the dimension of each parts of the fastener element 21 is based on the shape of the fastener element 21 projected in the longitudinal direction, namely, the shape without a draft angle. Note that the dimensions can be measured, for example, based on the enlarged image using a digital microscope or the like.

In the waterproof slide fastener 1 of the invention, reducing N than that in a conventional waterproof slide fastener generates a mechanism reducing the degree to which the neck parts 23 of the two adjacent fastener elements 21 push the coupling head 22 on the concave side when the waterproof slide fastener 1 is bent from the degree in the conventional waterproof slide fastener (namely, the "push reducing mechanism"), and increasing B than that in a conventional waterproof slide fastener generates a mechanism limiting the bending that is the force to push the coupling head 22 by causing the body parts 24 of the two adjacent fastener elements 21 to abut against each other even when the slide fastener is strongly bent (namely, the "bend limiting mechanism").

To prevent the coupling head 22 from being pushed, it is preferable to reduce N than that in the conventional slide fastener as much as possible and to increase B as much as possible. However, reducing N decreases the mechanical strength of the fastener elements 21, and increasing B decreases the flexibility of the waterproof slide fastener 1. Thus, the value of B/N is preferably between 2.5 and 3.5. In that case, the value of the B/N needs to be smaller than a distance P between the center lines of the two adjacent fastener elements 21 placed in the same direction. If the value is not smaller than the distance P, the distance G between the facing outer end edges of the body parts 24 does not exist. This causes the decrease in the flexibility of the waterproof slide fastener 1.

Figure 8:
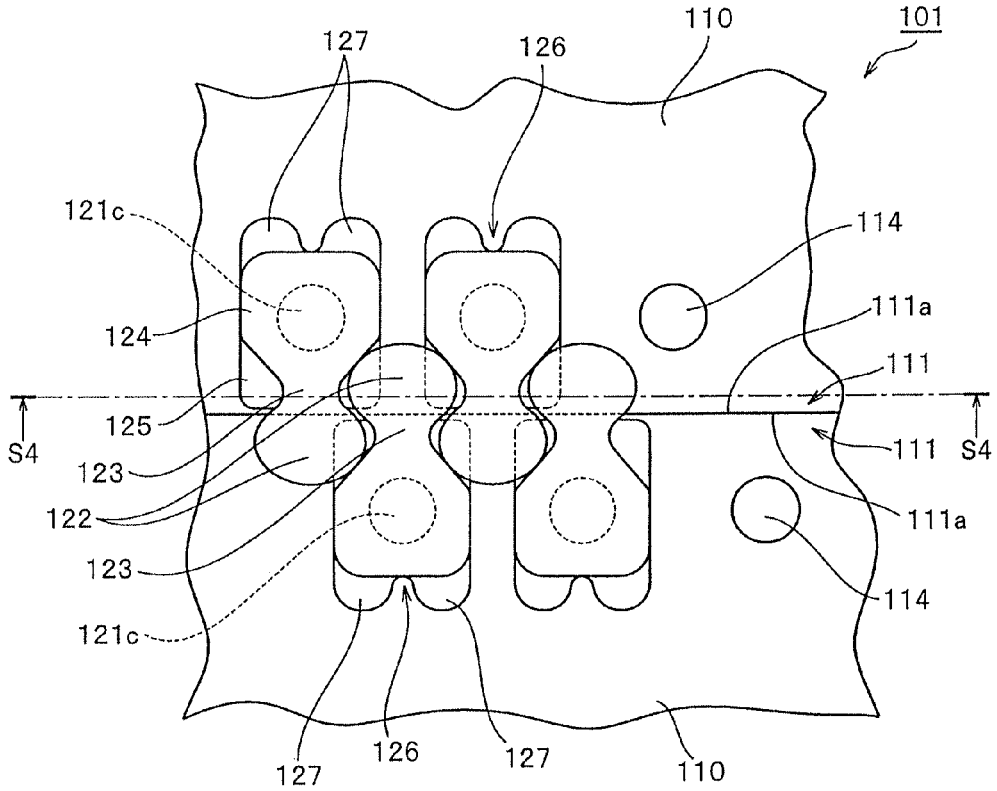
FIG. 8 is an elevation view of a publicly known waterproof slide fastener (in Patent Document 1).
Figure 9:
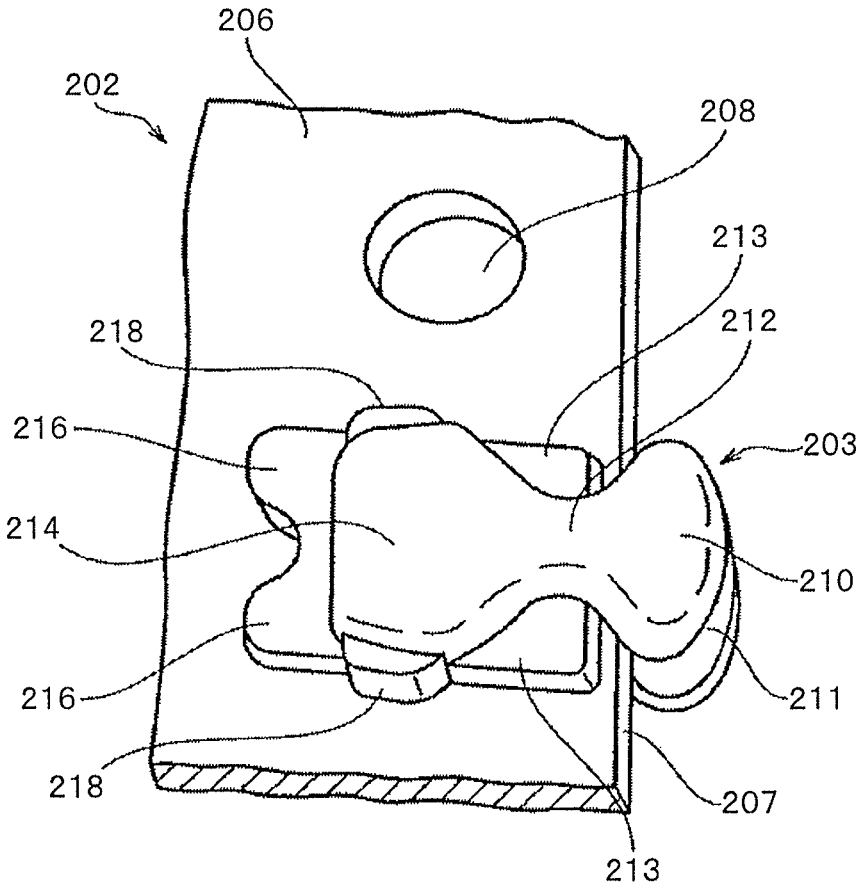
FIG. 9 is a perspective view of another publicly known waterproof slide fastener (in Patent Document 2) fastener stringer.
Figure 10:
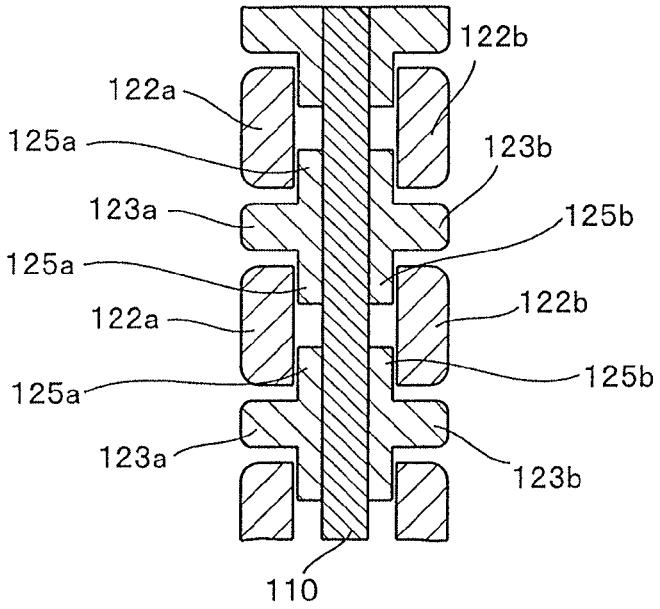
FIG. 10 is a cross-sectional view viewed along arrows S4-S4 of the waterproof slide fastener illustrated in FIG. 8.
Figure 11:
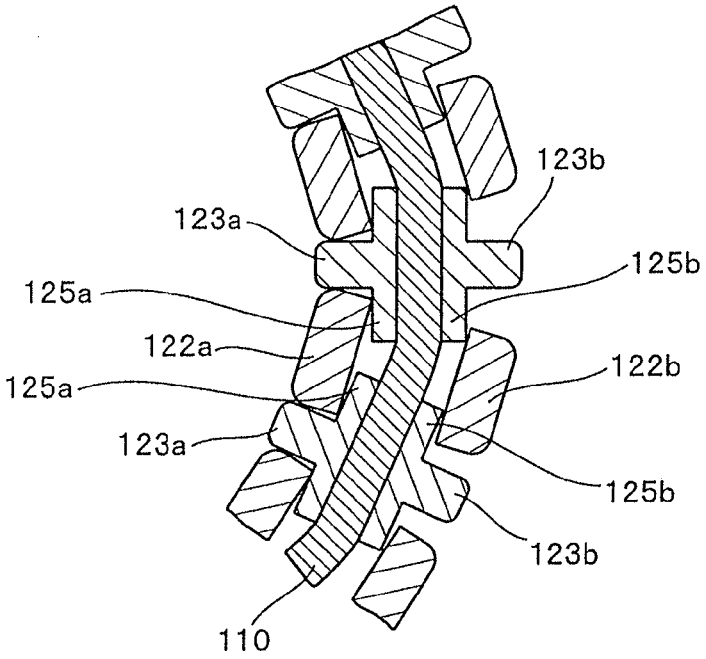
FIG. 11 is a cross-sectional view viewed along arrows S4-S4 of the waterproof slide fastener illustrated in FIG. 8 when the waterproof slide fastener is bent into a U shape in the vertical direction.

As described above, reducing N and increasing B from those in the conventional slide fastener causes the shape of the fastener element 21 of the waterproof slide fastener 1 of the invention (see FIG. 1) to have a largely-constricted neck part 23 and an extended shoulder as compared with the shape in the conventional slide fastener (see FIGS. 8 and 9).

As a concrete example shown as Example 1 in the following table 1, when L in a fastener element 21 is 6.75 mm, N can be designed as 1.35 mm and B can be designed as 4.02 mm. In that case, the value of the B/N is 2.98 (the value is rounded to two decimal places).

As Example 2, when L in a fastener element 21 is 6.75 mm, N can be designed as 1.35 mm and B can be designed as 3.67 mm. In that case, the value of the B/N is 2.72.

As Example 3, when L in a fastener element 21 is 6.90 mm, N can be designed as 1.35 mm and B can be designed as 4.70 mm. In that case, the value of the B/N is 3.48.

As Example 4, when L in a fastener element 21 is 5.90 mm, N can be designed as 1.20 mm and B can be designed as 4.10 mm. In that case, the value of the B/N is 3.42.

As Example 5, when L in a fastener element 21 is 5.90 mm, N can be designed as 1.20 mm and B can be designed as 3.50 mm. In that case, the value of the B/N is 2.92.

As Example 6, when L in a fastener element 21 is 6.80 mm, N can be designed as 1.63 mm and B can be designed as 4.20 mm. In that case, the value of the B/N is 2.58.

As Example 7, when L in a fastener element 21 is 6.80 mm, N can be designed as 1.63 mm and B can be designed as 4.55 mm. In that case, the value of the B/N is 2.79.

As Example 8, when L in a fastener element 21 is 4.70 mm, N can be designed as 0.97 mm and B can be designed as 2.90 mm. In that case, the value of the B/N is 2.99.

As Example 9, when L in a fastener element 21 is 4.70 mm, N can be designed as 0.97 mm and B can be designed as 3.15 mm. In that case, the value of the B/N is 3.25.

As Example 10, when L in a fastener element 21 is 4.70 mm, N can be designed as 1.10 mm and B can be designed as 3.20 mm. In that case, the value of the B/N is 2.91.

As Example 11, when L in a fastener element 21 is 4.70 mm, N can be designed as 1.10 mm and B can be designed as 3.00 mm. In that case, the value of the B/N is 2.73.

Note that, in the fastener element 21 of which L (entire length of the element) is almost the same as a conventional L (Comparative Example), N is around 1.53 to 1.63 mm, and B is around 3.64 to 3.77 mm. In that case, the value of the B/N is 2.23 to 2.47.

TABLE 1

| | EXAMPLE 1 L = 6.75 (mm) | EXAMPLE 2 L = 6.75 (mm) | EXAMPLE 3 L = 6.90 (mm) | EXAMPLE 4 L = 5.90 (mm) | EXAMPLE 5 L = 5.90 (mm) | EXAMPLE 6 L = 6.80 (mm) | EXAMPLE 7 L = 6.80 (mm) | EXAMPLE 8 L = 4.70 (mm) | EXAMPLE 9 L = 4.70 (mm) | EXAMPLE 10 L = 4.70 (mm) | EXAMPLE 11 L = 4.70 (mm) |
|---|---|---|---|---|---|---|---|---|---|---|---|
| B (mm) | 4.02 | 3.67 | 4.70 | 4.10 | 3.50 | 4.20 | 4.55 | 2.90 | 3.15 | 3.20 | 3.00 |
| N (mm) | 1.35 | 1.35 | 1.35 | 1.20 | 1.20 | 1.63 | 1.63 | 0.97 | 0.97 | 1.10 | 1.10 |
| H (mm) | 2.95 | 2.95 | 2.95 | 2.95 | 2.95 | 2.95 | 2.95 | 2.20 | 2.20 | 2.20 | 2.20 |
| P (mm) | 4.96 | 4.96 | 4.96 | 4.96 | 4.96 | 4.96 | 4.96 | 3.50 | 3.50 | 3.50 | 3.50 |
| G (mm) | 0.94 | 1.29 | 0.26 | 0.86 | 1.46 | 0.76 | 0.41 | 0.60 | 0.35 | 0.30 | 0.50 |
| B/N | 2.98 | 2.72 | 3.48 | 3.42 | 2.92 | 2.58 | 2.79 | 2.99 | 3.25 | 2.91 | 2.73 |
| (P − N − H)/G | 0.70 | 0.51 | 2.54 | 0.94 | 0.55 | 0.50 | 0.93 | 0.55 | 0.94 | 0.67 | 0.40 |

Figure 4:
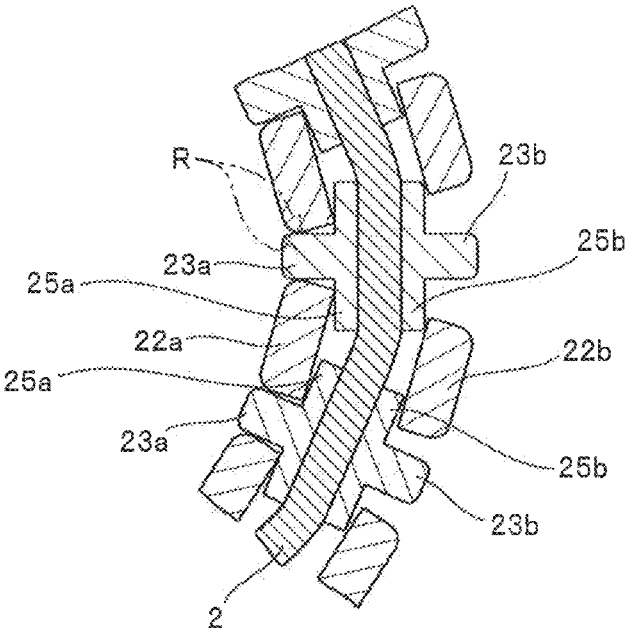
FIG. 4 is a cross-sectional view viewed along arrows S2-S2 of the waterproof slide fastener illustrated in FIG. 1 when the waterproof slide fastener is bent into a U shape in the vertical direction.
Figure 5:
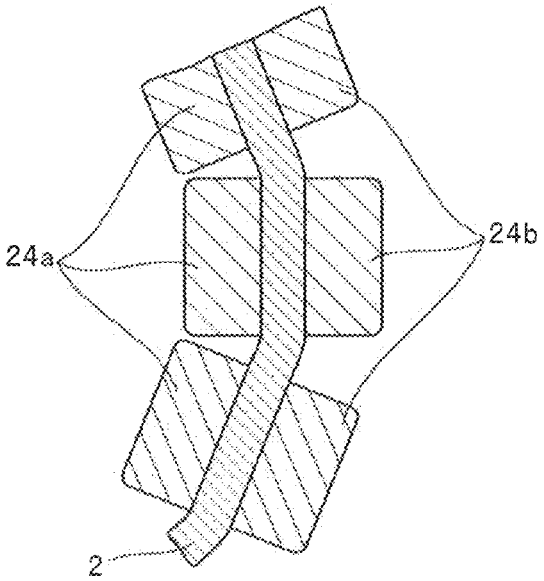
FIG. 5 is a cross-sectional view viewed along arrows S3-S3 of the waterproof slide fastener illustrated in FIG. 1 when the waterproof slide fastener is bent into a U shape in the vertical direction.

FIG. 4 is a cross-sectional view viewed along arrows S2-S2 of the waterproof slide fastener 1 illustrated in FIG. 1 when the waterproof slide fastener 1 is bent into a U shape in the vertical direction. FIG. 5 is a cross-sectional view viewed along arrows S3-S3 of the waterproof slide fastener 1 illustrated in FIG. 1 when the waterproof slide fastener 1 is bent into a U shape in the vertical direction. In FIG. 4, bending the slide fastener 1 in the vertical direction generates a mechanism such that the front half parts 23*a* of the neck parts 23 of the two adjacent fastener elements 21 push the front half part 22*a* of the coupling head 22 on the concave side. However, the value of the B/N is within the range described above even in that case. This causes the front half parts 24*a* of the adjacent body parts 24 to be close to each other as illustrated in FIG. 5. This causes the front half parts 24*a* of the adjacent body parts 24 to come into contact with each other and thus prevents the slide fastener 1 from being bent further. The bend limiting mechanism works.

As illustrated in FIG. 6, the vertical distance between the place at which the space between the outer end edges of the neck part 23 of a first fastener element 21 has the minimum width, and the coupling head 22*a* of a second fastener element 21 that is adjacent to the first fastener element 21 and faces the opposite direction of the first fastener element 21 can be expressed by (P−N−H)/2 when the slide fastener 1 is closed. In that case, the (P−N−H) of the distance indicates spaces (voids) when the coupling head 22*a* of the fastener element 21 of a fastener stringer is engaged between the neck parts 23*a* of the two adjacent fastener element 21 on the other fastener stringer 2 while the fastener elements 21 are engaged. The voids are formed on both the upward and downward outer end edges of the coupling head 22*a*. The space on one of the edges is thus expressed by (P−N−H)/2. It is preferable in the waterproof slide fastener 1 of the invention that a total distance (P−N−H) of the voids at two places on and under the place at which the space between the outer end edges of the neck part 23 of the first fastener element 21 has the minimum width, and a distance G between the outer end edges of the body parts 24 of the adjacent fastener elements 21 placed in the same direction satisfy the relationship of the following expression.

$$0.5 \leq (P-N-H)/G \leq 1.0 \qquad \text{Expression:}$$

It is not preferable that the value is smaller than 0.5 because the bend limiting mechanism does not work unless the bending progresses to a significant degree. It is not preferable also that the value is larger than 1.0 because this reduces the strength of the neck part 23 or reduces the flexibility of the waterproof slide fastener 1. In other words, the (P−N−H)/2 is the distance before the coupling head 22 and the half parts 23*a* of the neck part 23 of the adjacent fastener elements 21 come into contact with each other while the waterproof slide fastener 1 is bent into a U shape. The (P−N−H) is the distance from a coupling head 22 to the neck parts 23 on both sides of the coupling head 22 in the lengthwise direction of the waterproof fastener tape. This means that the distance of the (P−N−H) gradually decreases while the waterproof slide fastener 1 is bent into a U shape. After that, when the coupling head 22 and the neck parts 23 come into contact with each other, the value of the (P−N−H) is zero. When the waterproof slide fastener 1 is bent further, the distance G between the outer end edges of the body parts 24 of the two fastener elements 21 also decreases gradually. After that, the outer end edges come into contact with each other. As a result, (P−N−H)/G is an expression indicating a relationship necessary to limit a further bending of the slide fastener 1 by the contact of the half parts 24*a* of the adjacent body parts 24 even when the half parts 23*a* of the neck parts 23 of the two adjacent fastener elements 21 push the half part 22*a* of the coupling head 22 on the concave side of the slide fastener 1 while the slide fastener is bent. Note that each relationship between the dimensions is shown in the table 1, and the relationship is satisfied in each of the waterproof slide fasteners 1 in the table 1 except for the waterproof slide fasteners 1 in the embodiments 3 and 11.

Figure 7:
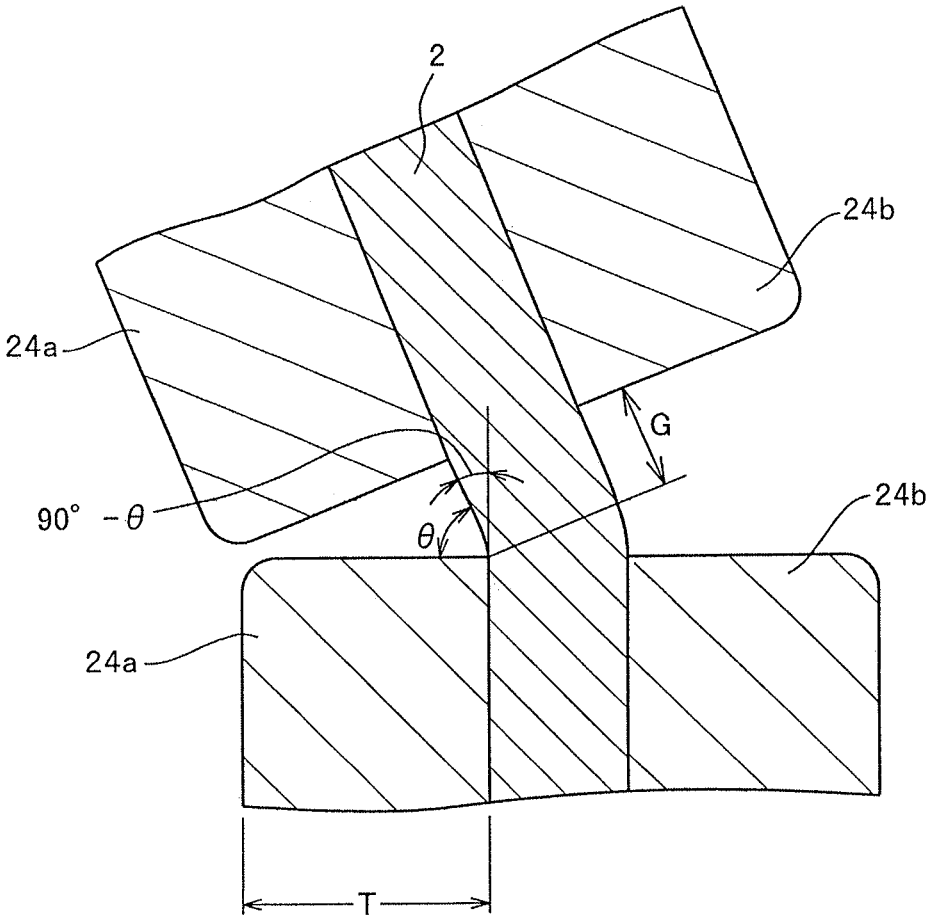
FIG. 7 is an enlarged view of FIG. 5.

In the waterproof slide fastener 1 of the invention, the following relationship between G and T as illustrated in FIG. 7 is preferably satisfied.

$$0.40 \leq G/T \leq 0.70 \qquad \text{Expression:}$$

G: the vertical distance between the outer end edges of the body parts 24 of two adjacent fastener elements 21 placed in the same direction T: the longitudinal height of the half part of the body part 24

According to the waterproof slide fastener 1 of the invention, the bend limiting mechanism works when the waterproof slide fastener 1 is bent strongly as described above. The expression prescribes the degrees to which the waterproof slide fastener 1 is bent when the bend limiting mechanism works.

The degrees will be described with reference to FIG. 7. The angle at which the bend limiting mechanism works (90°−θ) is preferably between 30° and 70° because it is not preferable that when an angle at which the bend limiting mechanism works is less than 30°, insufficient flexibility of the slide fastener is caused while it is not preferable that when the angle exceeds 70°, the degree to which the half parts 23*a* push the half part 22*a* is increased and thus the watertightness and airtightness are not maintained. When θ is approximated on the assumption that θ is nearly equal to $\cos^{-1}(G/T)$, $20° \leq \cos^{-1}(G/T) \leq 60°$ holds. This leads the above-mentioned expression.

As an example, when L in a fastener element 21 is 6.75 mm, G can be designed as 0.94 mm and T can be designed as 1.88 mm. In that case, the $\cos^{-1}(G/T)$ is 60°.

As another example, when L in a fastener element 21 is 6.75 mm, G can be designed as 0.91 mm and T can be designed as 1.50 mm. In that case, the $\cos^{-1}(G/T)$ is 52°.

As another example, when L in a fastener element 21 is 6.75 mm, G can be designed as 1.29 mm and T can be designed as 1.50 mm. In that case, the $\cos^{-1}(G/T)$ is 21°.

As another example, when L in a fastener element 21 is 4.7 mm, G can be designed as 0.60 mm and T can be designed as 1.20 mm. In that case, the $\cos^{-1}(G/T)$ is 60°.

As another example, when L in a fastener element 21 is 4.7 mm, G can be designed as 0.75 mm and T can be designed as 1.33 mm. In that case, the $\cos^{-1}(G/T)$ is 56°.

R is put on a ridge line portion on the upper face of the fastener element 21 of the waterproof slide fastener 1 of the invention. It is preferable that R on the ridge line portion of the coupling head 22 is 0.7 mm or less, and R on the ridge line portion of the neck part 23 is 0.4 mm or less. As described above, the ridge line portions of the coupling head 22 and the neck part 23 have a shape more rising perpendicularly as compared with those in the conventional slide fastener. This makes it difficult for the neck parts 23 of the two adjacent fastener elements 21 to push the coupling head 22. Therefore, the push reducing mechanism is further enhanced.

As an example, R on the ridge line portion of the coupling head 22 can be designed as 0.3 mm (conventionally around 0.8 mm), and R on the ridge line portion of the neck part 23 can be designed as 0.2 mm (conventionally around 0.5 mm).

The half parts of the fastener elements 21 of the waterproof slide fastener 1 according to the invention can include a leg part, but preferably include two or more leg parts (in FIG. 1, the leg part 27 of the front half part 21*a* of the fastener element 21 branches from a crotch portion 26 into two leg parts 27*a*, 27*a*). As described above, the leg part branches into two or more parts. This can reduce the area of the leg part per half part of the fastener element 21 on a sliding contact face on which the flange portion of the slider is led and slid. This reduces the sliding resistance when the slider slides and thus can cause the slider to lightly slide.

Note that the front faces of the coupling head 22, neck part 23, and body part 24 of the fastener element 21 are placed on a plane and form a flat surface. However, a part of the front face of the body part 24 can have a recess as a design.

The slider (not illustrated in the drawings) is made of a synthetic resin or a metal and has the same structure as the slider used for a conventional common waterproof slide fastener.

REFERENCE SIGNS LIST

1 Waterproof slide fastener
2 Fastener stringer
10 Waterproof fastener tape
11 Element attachment edge part
11*a* End edge
12 Belt-shaped core material
13 Waterproof layer
14 Through-hole
21 Fastener element
21*a*, 21*b* Front and rear half parts of a fastener element
21*c* Connecting portion
22 Coupling head
22*a*, 22*b* Front and rear half parts of a coupling head
23 Neck part
23*a*, 23*b* Front and rear half parts of a neck part
24 Body part
24*a*, 24*b* Front and rear half parts of a body part
25 Shoulder part
25*a*, 25*b* Front and rear half parts of a shoulder part
26 Crotch portion
27 Leg part
27*a*, 27*b* Front and rear half parts of a leg part
B Vertical width between the outer end edges of the body part of each of the fastener elements
G Vertical distance between the facing outer end edges of the body parts of the two adjacent fastener elements placed in the same direction
S Vertical width between the outer end edges of the shoulder part of each of the fastener elements
P Vertical distance between the center lines of the two adjacent fastener elements placed in the same direction
H Vertical maximum width between the outer end edges of the coupling head of each of the fastener elements
N Vertical minimum width between the outer end edges of the neck part of each of the fastener elements
L Horizontal length between the front end edge of the coupling head and the front end edge of the leg part in each of the fastener elements
T Longitudinal height of the half part of the body part of each of the fastener elements

The invention claimed is:

1. A waterproof slide fastener including:

a pair of fastener stringers including a plurality of fastener elements arranged along facing element attachment edge parts of a pair of waterproof fastener tapes in which a waterproof layer made of an elastomer resin is formed on a woven or knitted belt-shaped core material; and a slider configured to engage and disengage the fastener elements, wherein each of the fastener elements is made of a synthetic resin material and includes front and rear half parts integrally formed on front and rear face sides of one of the waterproof fastener tapes, and the front and rear half parts each include a coupling head, a neck part continuously formed from the coupling head and constricted in a lengthwise direction of the one of the waterproof fastener tapes, and a body part continuously formed from the neck part, the front and rear half parts are integrally connected to each other with a connecting portion through a through-hole formed on the element attachment edge part, end edges of the element attachment edge parts are formed such that edge faces of the facing waterproof fastener tapes are in contact with each other when the fastener elements are engaged, when a minimum width between outer end edges of the neck part in the lengthwise direction of the one of the waterproof fastener tapes is N, and a width between outer end edges of the body part in the lengthwise direction of the one of the waterproof fastener tapes is B, a value of B/N is between 2.5 and 3.5, and in the fastener element, a total distance (P−N−H) of two voids at a place at which the width between the outer end edges of the neck part is minimum in the lengthwise direction of the one of the waterproof fastener tapes, and G that is a distance between outer end edges of two adjacent body parts placed in a same direction satisfy an expression: $0.5 \leq (P-N-H)/G \leq 1.0$ wherein P indicates a distance, in the lengthwise direction of the one of the waterproof fastener tapes, between center lines of two adjacent fastener elements placed in the same direction, and H indicates a maximum width, in the lengthwise direction of the one of the waterproof fastener tapes, between outer end edges of the coupling head of each of the fastener elements.

2. The waterproof slide fastener according to claim 1, wherein B has a value larger than S that is a width between outer end edges of the shoulder part in the lengthwise direction of the one of the waterproof fastener tapes in the fastener element.

3. The waterproof slide fastener according to claim 1 wherein R (radius of curvature) at a ridge line portion on an upper face of the coupling head is 0.7 mm or less, and R (radius of curvature) at a ridge line portion on an upper face of the neck part is 0.4 mm or less in each of the fastener elements.

* * * * *